US005353454A

United States Patent [19]

Callaway et al.

[11] Patent Number: 5,353,454

[45] Date of Patent: Oct. 11, 1994

[54] ADJUSTABLE LUMBAR SUPPORT FOR FLOTATION SYSTEMS

[75] Inventors: Milton A. Callaway, Dahlonega; Charles E. Steed, Alpharetta, both of Ga.; Lynn D. Larson, Lincoln, Nebr.

[73] Assignee: Simmons Company, Atlanta, Ga.

[21] Appl. No.: 110,890

[22] Filed: Aug. 24, 1993

Related U.S. Application Data

[60] Division of Ser. No. 850,480, Mar. 12, 1992, Pat. No. 5,245,716, which is a continuation-in-part of Ser. No. 673,203, Mar. 21, 1991, Pat. No. 5,144,707.

[51] Int. Cl.[5] ..... A47C 27/08

[52] U.S. Cl. ..... 5/451; 5/917

[58] Field of Search ..... 5/451, 450, 917, 449, 5/452, 422, 464

[56] References Cited

U.S. PATENT DOCUMENTS

| | | | |
|---|---|---|---|
| 3,732,585 | 5/1973 | Krembiel | 5/400 |
| 5,072,469 | 12/1991 | Boyd | 5/464 |
| 5,077,848 | 1/1992 | McDaniel et al. | 5/451 |
| 5,285,541 | 2/1994 | Steed et al. | 5/917 |

*Primary Examiner*—Alexander Grosz
*Attorney, Agent, or Firm*—Jones & Askew

[57] ABSTRACT

A water mattress construction is provided with a tray providing a cavity adapted to support a liquid filled bladder, with at least one lumbar support member positioned intermediate the bladder and the tray, the lumbar support being slidably adjustable along the longitudinal axis of the tray.

3 Claims, 9 Drawing Sheets

ADJUSTABLE LUMBAR SUPPORT FOR FLOTATION SYSTEMS

This application is a divisional of Ser. No. 850,480, filed Mar. 12, 1992, now U.S. Pat. No. 5,245,716 issued on Sep. 21, 1993, which application is a continuation-in-part of Ser. No. 673,203, filed on Mar. 21, 1991, now U.S. Pat. No. 5,144,707 issued Sep. 8, 1992.

TECHNICAL FIELD

This invention relates in general to bedding, and more particularly to flotation bedding systems including improved locking features for maintaining one or more water- or other fluid-filled bladders within a cavity in order to provide a supporting surface for sleeping or reclining thereon. Important features of the invention include sliding or "gliding" features, as well as particular locking features. The invention also relates to a water mattress configuration which includes an adjustable lumbar support, improved cushioning qualities, and improved heat transfer properties.

BACKGROUND OF THE INVENTION

In bedding configurations, a need has been recognized for configurations which provide comfortable supporting surfaces. It is known in the art to include water- or other fluid-filled bladders in order to support a user thereon. For example, U.S. Pat. No. 3,585,356 to Hall, entitled "Liquid Support for Human Bodies", hereby incorporated by reference, discloses an article of furniture comprising a flexible bladder which is substantially filled with a liquid. In Hall, a supporting framework is provided for holding the liquid filled bladder in such a manner such that a body resting on the bladder is floatably supported by the liquid.

U.S. Pat. No. 4,015,299 to Tinnel, entitled "Water Bed", hereby incorporated by reference, discloses a water bed construction including an upwardly opening rectangular "coffer" formed by polyurethane sheet and a polyurethane perimetrical members disposed thereon. The coffer cavity receives and contains a water mattress, and a foam pad is disposed thereon.

U.S. Pat. No. 4,221,013 to Echevarria, entitled "Fluid Floatation Sleep System", hereby incorporated by reference, discloses a fluid flotation system including a pair of registering frame members, which combine to capture one or more fluid-filled bladders therein.

U.S. Pat. No. 4,245,362 to Mueller, and U.S. Pat. No. 4,245,362 to Callaway, each entitled "Flotation Mattress", hereby incorporated by reference, each disclose the use of springs in combination with foam in order to capture a fluid-filled bladder therein.

Although the above configurations do include features having distinct advantages, a need has still been recognized to provide a waterbed system which is simple to assemble and utilize. Furthermore, a need has been recognized for a waterbed system having an interior which is easy to access for display and/or maintenance, but also may be readily closed to maintain its interior components securely therein. A need has also been recognized for water mattress configuration which includes an adjustable lumbar support, improved cushioning qualities, and improved heat transfer properties.

SUMMARY OF THE INVENTION

The present invention provides an improvement over the prior art by satisfying the above criteria, in part by providing an improved cavity locking system which may be easily unlocked in order to access the interior bladder-holding cavity for promotional display or maintenance, but may also be easily and reliably locked in order to maintain the bladder or bladders securely therein. Also provided is a waterbed mattress configuration which provides improved lumbar support properties, improved cushioning properties, and improved heat transfer properties.

Generally described, the present invention provides a water mattress construction which includes an improved perimeter locking system. The invention also provides a water mattress construction which includes an improved cantilevered corner in the tray, an adjustable lumbar support, and improved side walls, all of which provide more comfort to the user.

It is an object of the present invention to provide a bedding configuration having an improved supporting surface.

It is a further object of the present invention to provide a bedding configuration which may be displayed for promotional purposes.

It is a further object of the present invention to provide a bedding configuration which includes a smooth sliding or "gliding" assembly feature.

It is a further object of the present invention to provide a bedding configuration having an interior which may be displayed for promotional purposes.

It is a further object of the present invention to provide a flotation bedding configuration which may be easily assembled by a typical consumer.

It is a further object of the present invention to provide a flotation bedding configuration having an interior cavity which may be easily accessed by a typical consumer.

It is a further object of the present invention to provide a flotation bedding configuration having an interior cavity which may be easily closed and secured by a typical consumer.

It is a further object of the present invention to provide a flotation bedding configuration having improved means for detecting leaks and punctures in its bladder or bladders.

It is a further object of the present invention to provide a flotation bedding configuration having a built-in maintenance recorder.

It is a further object of the present invention to provide an improved water mattress configuration, which includes improved support characteristics, particularly in the "lumbar" region.

It is further object of the present invention to provide an improved water mattress configuration which provides adequate support, but does not include uncomfortable excessively "hard" areas.

It is a further object of the present invention to provide an improved water mattress configuration which includes improved heat transfer properties.

It is a further object of the present invention to provide an improved water mattress configuration which is cost-efficient to manufacture and use.

It is a further object of the present invention to provide an improved water mattress configuration which discourages improper positioning of heaters therein.

Other objects, features, and advantages of the present invention will become apparent upon reading the following detailed description of the preferred embodiment of the invention when taken in conjunction with the drawings and the appended claims.

DETAILED DESCRIPTION OF THE PREFERRED EMBODIMENT

This is in reference to the drawings, in which like numerals represent like parts throughout the several views. For purposes of this application, various references may be made to elements being "upper" or "lower" relative to other elements. Of course, it should be understood that such terms "upper" and "lower" are merely relative as to the point of reference of the viewer. Furthermore, terms such as "head" and "foot" ends of the mattress are used in order for ease of discussion. It should be understood that such terms are used in order to differentiate ends so identified and should not be interpreted as limiting. In describing the mattress, it will be assumed that its "bottom" is resting on a horizontal supporting surface.

First Preferred Embodiment

Figure 4:
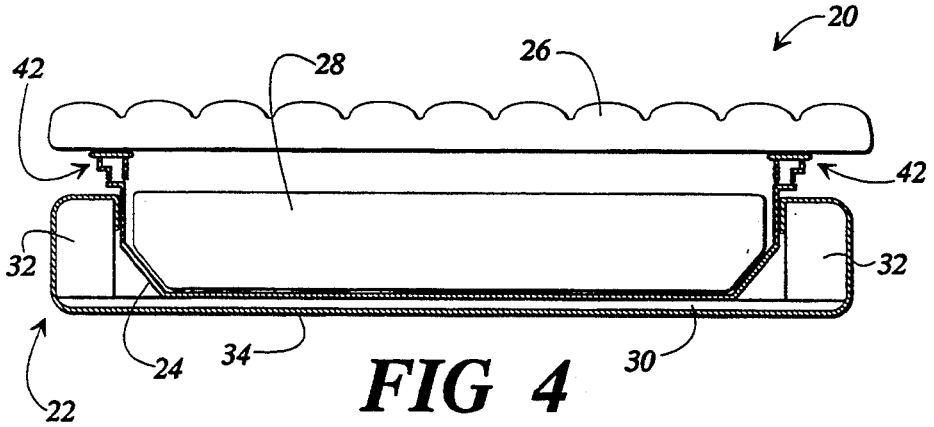
FIG. 4 is an end cross-sectional semi-exploded view of the mattress assembly according to a first embodiment of the invention.

Referring to FIG. 4, it illustrates a first preferred mattress embodiment 20 of the invention, which generally includes a base 22, a plastic tray 24 disposed within the base, and a top cover 26 atop the base-tray combination. The tray 24 and cover 26 combine to define an interior cavity which accepts a water- or other fluid-filled bladder 28 (or more than one bladder). A person positioned atop the cover 26 may be at least partially supported by the fluid bladder or bladders.

Figure 1:
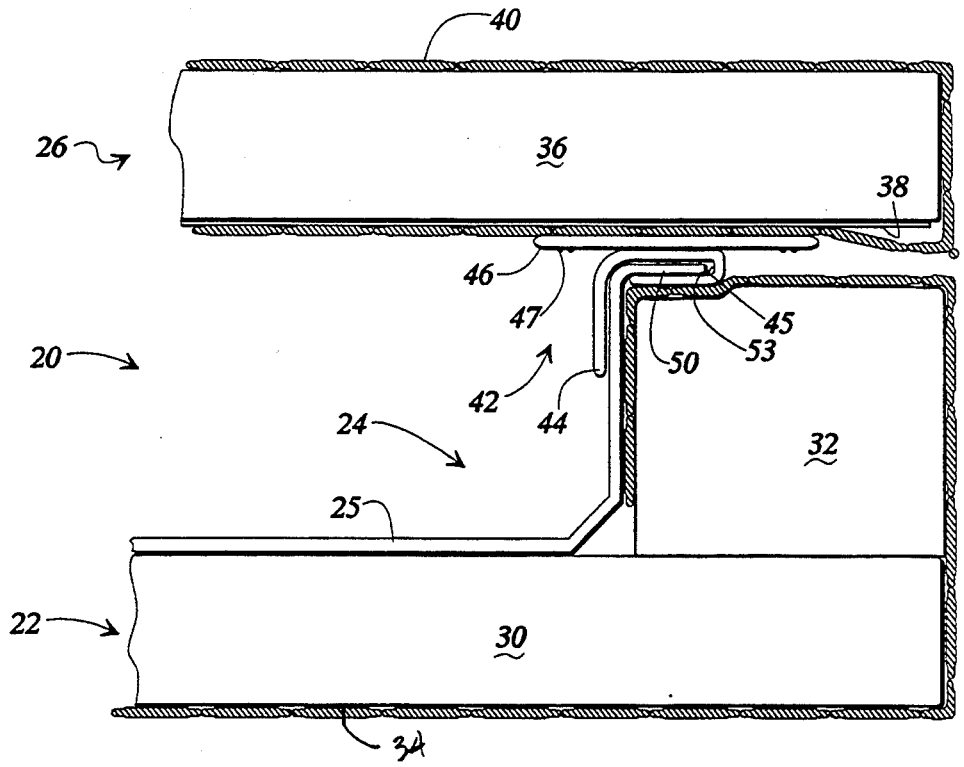
FIG. 1 is a partial cross-sectional view of a portion of a first embodiment of the invention, illustrating the interlocking of the side flange of a tray with a corresponding channel assembly.

Referring now also to FIG. 1, the base 22 itself includes a flat bottom foam layer 30, a foam perimeter 32, and an overlayer of quilting or other decorative fabric 34. The bottom layer 30 is substantially uniform in thickness, and has a substantially rectangular shape, having upper and lower primary planar surfaces being substantially parallel, two substantially parallel side surfaces, and two substantially parallel "head" and "foot" end surfaces. The foam perimeter 32 extends about the marginal edges of the lower layer 30, and is attached to its upper primary planar surface by glue or other attachment means known in the art. The foam perimeter in the preferred embodiment is composed of four elongate foam members, each having a substantially rectangularly-shaped transverse cross section and being substantially straight. The ends of the four foam members meet in order to combine to make a continuous foam perimeter rectangular in shape.

It should be understood that other configurations could be used in providing such a base; a large block of material could be used which is "hollowed" out by suitable machining practices known in the art. Furthermore, a bottom layer may not be used as in another embodiment shown below.

The tray 24 includes a floor portion 25 (see FIG. 1 only), as well as two side walls and two end walls. Each of the four walls of the tray extends upwardly from the floor portion and includes an inclined wall portion extending upwardly from the floor portion, and a vertical wall portion extending upwardly from the inclined wall portion. From each of the two side walls of the tray extends a horizontally-disposed side flange 50, and from each of the two end walls of the tray extends a horizontally-disposed end flange 52 (discussed in further detail below).

In this embodiment the tray is composed of a single layer of plastic or other suitable material which is molded into a mold through a process known in the art as "vacuum molding". However, other configurations may be used, and it is not necessary that the tray be of unitary construction.

Figure 2:
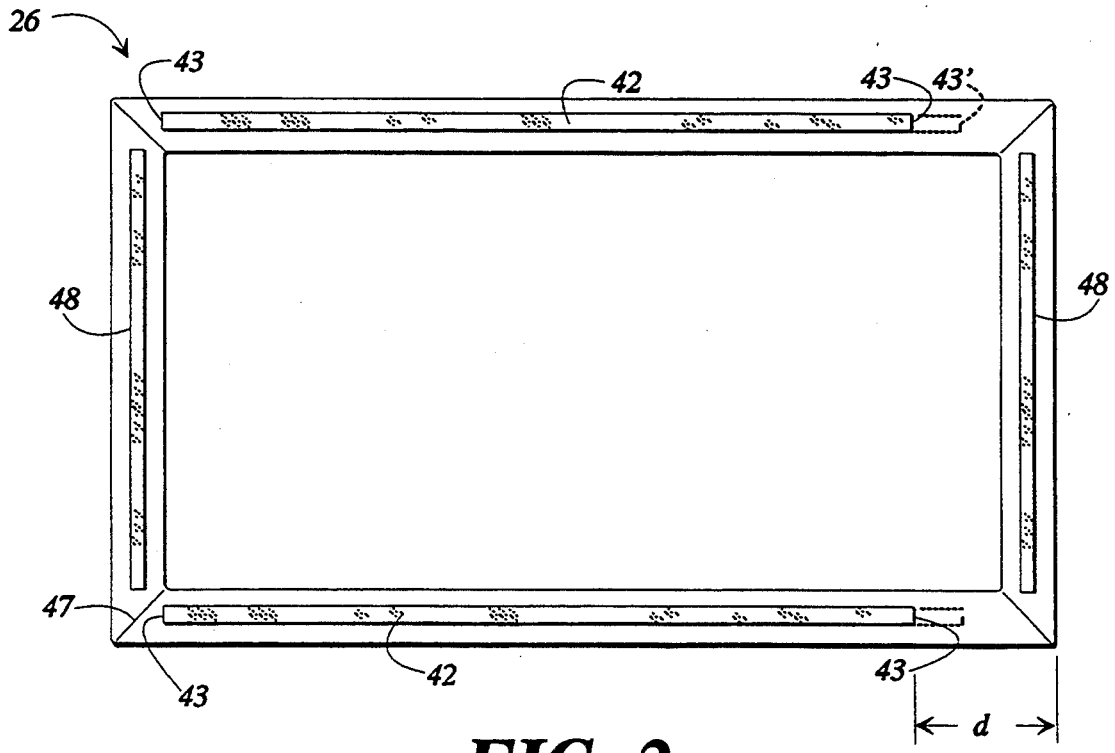
FIG. 2 is a bottom plan view of the top cover of a first embodiment of the invention.

The top cover 26 includes a rectangular foam layer 36 with a fabric layer 38 positioned beneath the foam layer 36, and a layer of quilting 40 positioned over the top of the foam layer 36 and partially overlapping the fabric layer 38. As shown in FIG. 2, the fabric, 38 is folded at the comers of the top cover in an abutting relationship at 47.

A pair of elongate channel assemblies 42 extend along the lower surface of the top cover 26. In the preferred embodiment, each channel assembly 42 is coextruded, including a channel portion 44 being of a first plastics material (PVC in this embodiment), and a top flange portion 46 which is of a second plastics material less rigid than the material composing portion 44 (latex rubber in the preferred embodiment). The flange portion 46 is sewn at 47 or otherwise attached to the underside of the top cover 26.

Referring now also to FIG. 2, it may be seen that the pair of channel assemblies 42 extend only partly along the entire length of the top cover 26 with their longitudinal axes being substantially coparallel. At the "head" and "foot" ends of the top cover 26 are positioned a pair of fastening strips 48, each attached to the underside of the top cover 26. These fastening strips 48 are either the "hook" or "loop" elements of a typical hook-and-loop connecting system such as that known in under the VELCRO® trademark. These fastening strips 48 cooperate with two fastening strips 49, one each attached at the head and foot ends of the base (see FIG. 3).

Figure 3:
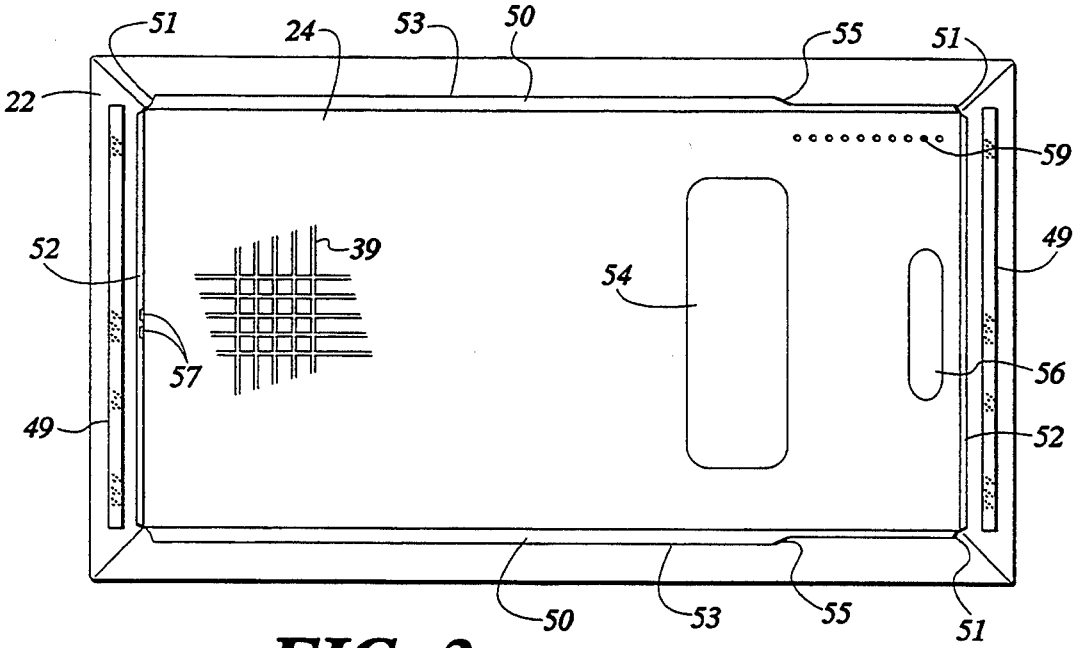
FIG. 3 is a top plan view of the tray and base of a first embodiment of the invention, without any water-filled bladders in place within the tray.

In FIG. 3, the tray 24 is shown nested within the upwardly-disposed cavity of the base 22. At the sides of the tray extend a pair of opposing side flanges 50 (see also FIG. 1), which extend in an opposing relationship and each terminate in an edge 53. The flanges 50 are accepted by the channel portion 44 of the channel assembly 42 as best shown in FIG. 1, but discussed in further detail below.

At the "head" and the "foot" of the tray 24 extend a pair of vertical flanges 52 which extend in an opposing relationship to each other. In the preferred embodiment shown in FIG. 3, it may be understood that these flanges 52 do not extend outwardly from the end walls of the tray as much as do the flanges 50 extend from the side walls. In an alternative embodiment, flanges 52 may be non-existent, in order to reduce the potential that they will be felt by one sitting at the head or foot of the mattress.

The upwardly-disposed tray 24 may include an upwardly-disposed water heater reservoir 54, as well as a fluid reservoir 56. It may be understood that each of these reservoirs is provided by a portion of the floor of the tray 24 extending downwardly somewhat relative to an adjacent portion. In the case of the heater reservoir (which is in place in order to situate a typical water bed heater), it may be preferable that this reservoir be situated within a "plateau", thus maintaining the heater, although itself in a depression, somewhat above the main floor of the tray to prevent contact with leaking water. In the case of the fluid reservoir depression, it is preferable that this depression 56 be the lowermost portion of the floor of the tray 24, with as much of the floor as possible being inclined toward the depression, such that water leaking from anywhere within the tray tends to be directed into the depression 56. A pair of "snap-slots" 57 (see FIG. 3) are provided in the head end wall of the tray to secure a heater cord passing thereover.

The tray 24 includes a calendar 59, which is basically a plurality of depressions configured to accept a peg. Each of the depressions are assigned a particular date, in order that the user may recall his or her last date of servicing the mattress.

Interaction of the channel assemblies 42 with the two flanges 50, which allows the top cover 26 to be attached to the tray, is now discussed.

As may be seen in FIG. 3, the side flanges 50 are tapered somewhat at their ends 51, and there is a step-down of the flanges at 55. This is to facilitate ease of insertion of these ends 51 into the "head" ends 43 of the channel assemblies 42.

Figure 5:
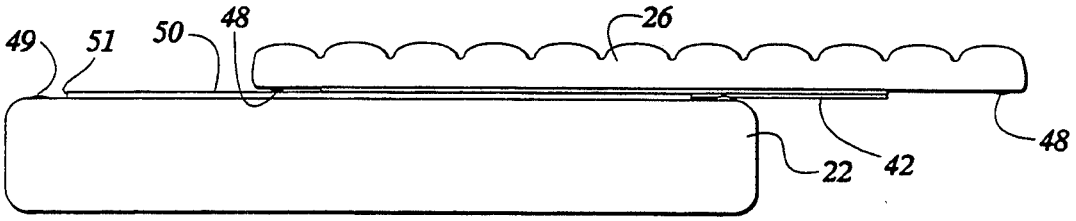
FIG. 5 is a side illustrative view of the manner in which the top cover of the first embodiment is "slid" into place.

Referring now also FIG. 5, it will be assumed that the base 22 is positioned atop a substantially horizontal supporting surface such as a foundation or box spring. The top cover 26 is positioned such that the longitudinal axes of the channel assemblies 42 are substantially parallel with the longitudinal axes of the elongate side flanges 50 of the tray, and the top cover is at the "foot" end of the base and tray. The leading "head" ends 43 of the channel assemblies 42 are then positioned relative to the "foot" ends of the flanges 50, such that the flanges 50 enter within the channel 45 defined by the channel portion 46 of the channel assemblies 42. The top cover is then continuously urged toward the head of the base and tray (either by pulling or pushing) such that more and more of the lengths of the flanges 50 are slidably accepted within their corresponding channel assemblies 42. Eventually, the top cover 26 will be positioned such that it is covering the bladder 28 and basically is in registration with the base, such that its fastening strips 48 are facing fastening strips 49 of the base 22. At this time, a downward pressure may be provided in the location of the fastening strips 48, 49, in order to insure their coengagement.

Figure 6:
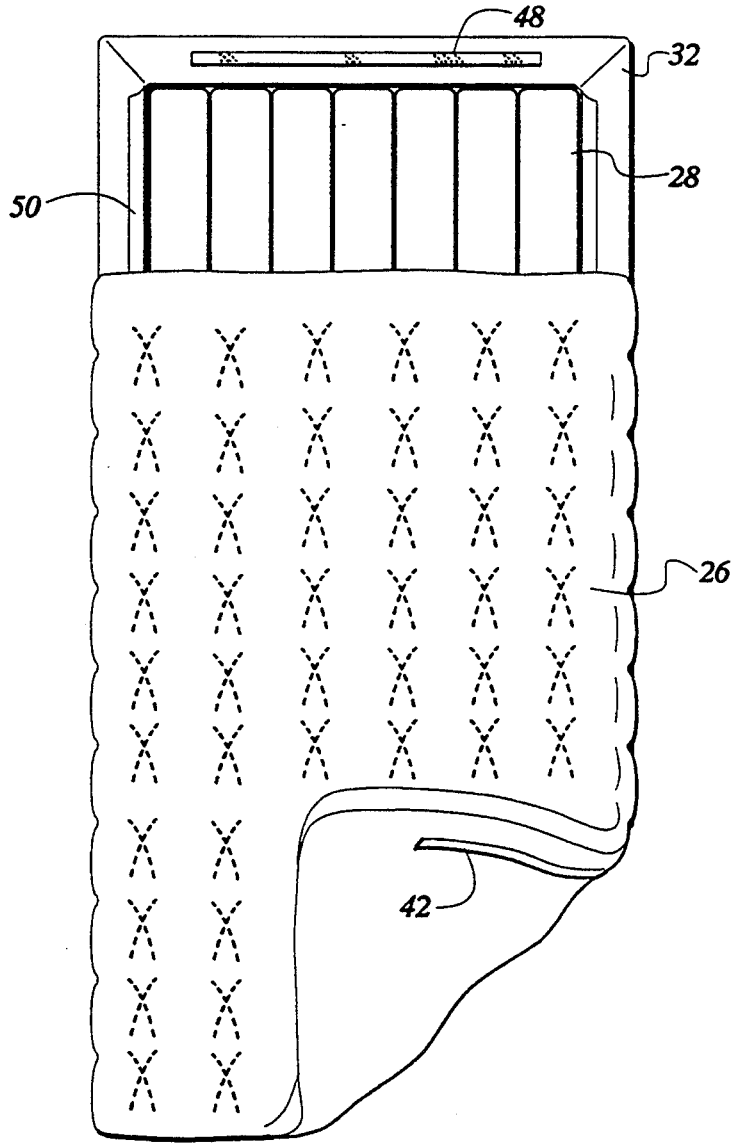
FIG. 6 is a top illustrative view of the manner in which the top cover of the first embodiment is "slid" into place, with a portion of the top cover bent back to illustrate the positioning of a channel assembly. Multiple water-filled bladders are shown in place.

The above sliding or "gliding" feature is an important part of the invention. It may be seen that a smooth assembly action is provided, which is easy for even the least skilled user to perform. Such a feature is well illustrated in FIG. 6.

As described above, the preferred insertion of the top cover is from the foot of the base and tray. However, it may be understood that the cover 26 may, in this preferred embodiment, be "slid in" from either and (head or foot) of the base.

As may be seen with respect to FIG. 2, the elongate channel assemblies 42 attached to the top cover 26 do not extend the entire length of the top cover, instead stopping short of the ends of the cover. It may be seen that a certain distance "d" exists between the "foot" ends 43 of the channel assemblies 42 and the ends of the top cover 26.

Figure 7:
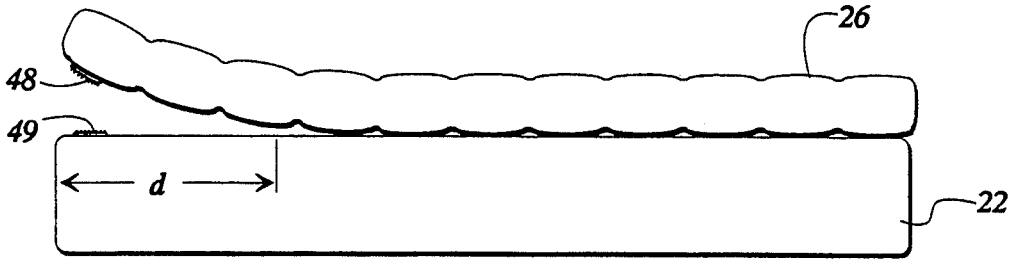
FIG. 7 is a side illustrative view of the manner in which a portion of the top cover of the first embodiment is bent out of place in order to access the interior of the mattress.

Referring now also to FIG. 7, it may be seen that this distance d provides for access to the interior cavity of the mattress 20, without initiation of the previously-discussed sliding motion. Instead, at the foot end of the assembly 20, the previously-discussed engagement of one pair of the respective fastening strips 48, 49, of the top cover 26 and base 22 may be disengaged. Upon such disengagement, the top cover, being flexible, may be bent out of the way as shown in FIG. 7 to provide access to the interior of the mattress 20.

This access may serve at least two purposes. First of all, typically in displaying such mattresses for promotional and/or sale purposes, it is often desired to illustrate at least a portion of the mattress in its completely assembled state. However, at the same time, there is also a need to illustrate the inner elements of the mattress construction, not least of all the bladder or bladders contained therein, in order to promote or exhibit potentially marketable aspects of the mattress construction. The water mattress according to the present invention provides for such a need.

Secondly, after a water mattress has been obtained by a purchaser, there is an obvious need to allow the consumer to easily access the interior elements of a water mattress, without undue burden which is often required in disassembling prior art constructions. However, as may be seen, at least the foot end of the water mattress may be easily accessed without totally removing the top. As the heaters, thermostats, etc. may be positioned at such end, the mattress may be readily serviced or maintained without the requirement that the top cover 26 be entirely removed by the above-reference sliding motion. Access to the head end of the mattress could be provided by shortening the channel assemblies at that end.

It may be understood that the channel assemblies may be shorter or longer as desired without departing from the spirit and scope of the present invention. For example, one of its ends may extend as shown at 43 in FIG. 2. Furthermore, the length of the edge flanges 50 could be shortened or lengthened to allow the top cover to be bent out of the way to the extent it is not connected to the tray.

Figure 8:
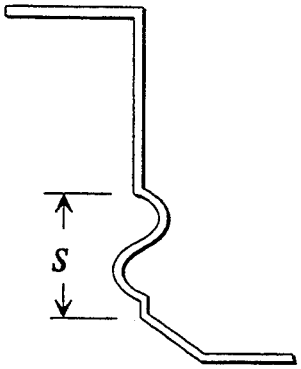
FIGS. 8 and 9 are cross-sectional views of alternate side walls of a tray, including "spring portions".
Figure 9:
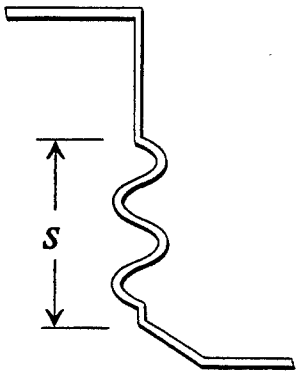

Referring now to FIGS. 8 and 9, an alternative tray wall design is illustrated, which includes a spring region "S" in the side wall of the tray, which allows for vertical deflection of the side walls of the tray, which may be desired if a person is lying or sitting at a location immediately above the side walls.

It may be understood that it is not necessary that the above-described spring region be curvilinear in form. Other configurations are also contemplated which allow a wall to be deflected along its length.

Second Preferred Embodiment

Figure 10:
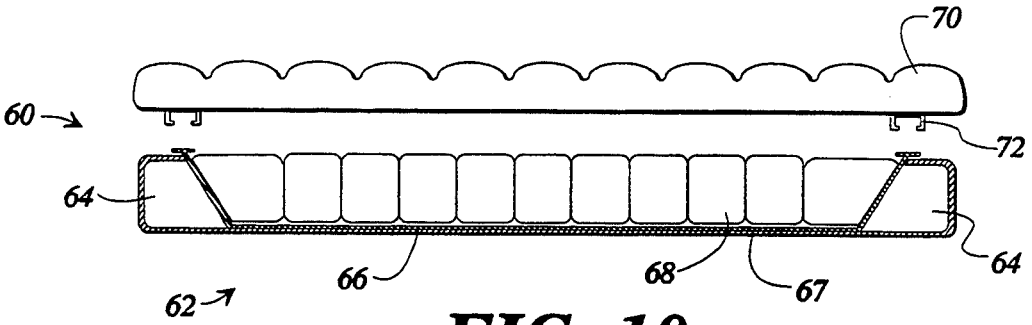
FIG. 10 is an end cross-sectional semi-exploded view of the mattress assembly according to a second embodiment of the invention.

Referring now to FIG. 10, a second preferred embodiment of the second invention is illustrated. A water mattress 60 is illustrated, which includes a base 62 (including a foam perimeter 64), a tray 66, and a plurality of fluid-containing bladders 68 positioned within the tray, and a top cover 70. Channel assemblies 72 are attached to the underside of the top cover 70.

The base 62 does not include a flat "bottom" member (although it could), but instead only includes a rectangularly-shaped foam perimeter 64 composed in the preferred embodiment of four elongate foam members. The transverse cross sections of the four members of the perimeter 64 are similar and each includes a vertical outside side surface, horizontal upper and lower side surfaces, and an inclined interior side surface. A fabric layer 67 extends completely underneath the foam perimeter, and wraps at least partially around the perimeter as well.

The side walls of the tray 66 shown in FIG. 10 are inclined outwardly at a slope approximating that of the interior side surfaces of the perimeter 64, in order to encourage nesting of the two elements.

Figure 11:
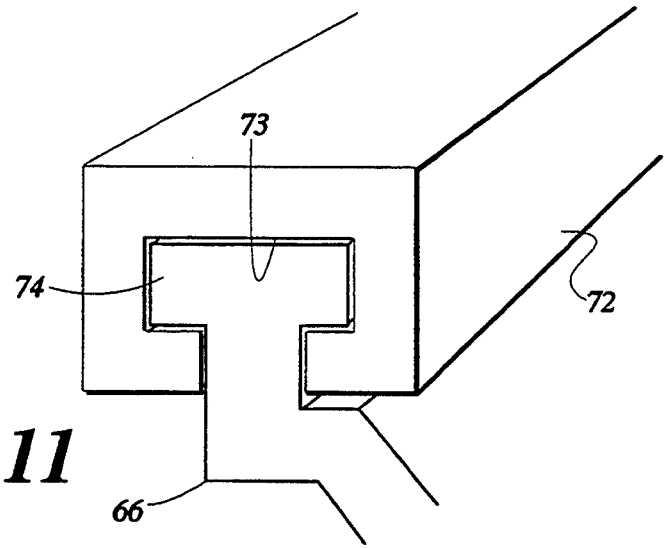
FIG. 11 is an isolated view illustrating the sliding connection between the top cover and tray of the assembly of FIG. 10.

Referring now also to FIG. 11, each of the two channel assemblies 72 defines an interior channel 73, which is configured to accept the T-shaped cross-section of elongate T-shaped members 74 provided at the upper side edges of the tray 66. As in the previously-described first embodiment, these assemblies 72 may not extend completely the length of the mattress 60, but may stop short in order to provide access to the ends of the mattress as described above. The hook-and-loop configurations described above may also be used in this configuration.

Third Preferred Embodiment

Figure 12:
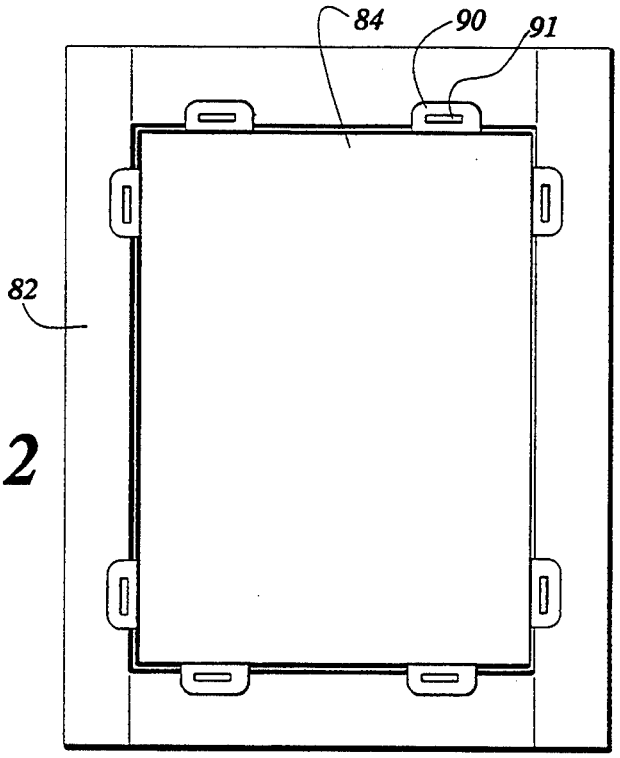
FIG. 12 is a top plan view of the tray and base of a third embodiment of the invention, without any water-filled bladders in place within the tray.
Figure 13:
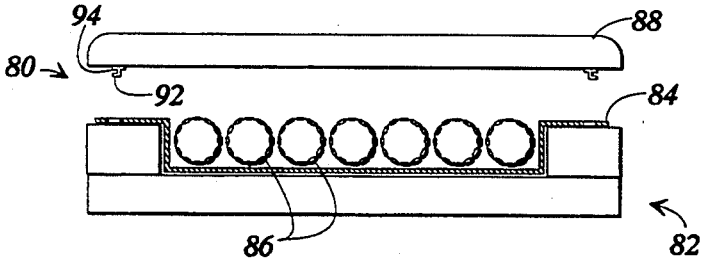
FIG. 13 is a side cross-sectional semi-exploded view of the mattress assembly according to a third embodiment of the invention.

Referring now to FIGS. 12 and 13, a third preferred embodiment of the present invention is described. A mattress 80 includes a base 82, which itself accepts a tray 84 nested therein. The tray 84 likewise accepts a plurality of elongate fluid-filled bladders 86 therein. Atop the bladders and base 82 is positioned a top cover 88. The bladders can run head-to-foot or side-to-side, although they are shown side-to-side in FIG. 12.

The base 82 of this embodiment is similar to that shown in FIG. 1 and includes a lower foam layer having a rectangularly-shaped foam perimeter attached along its marginal edges on its upper surface.

Figure 14:
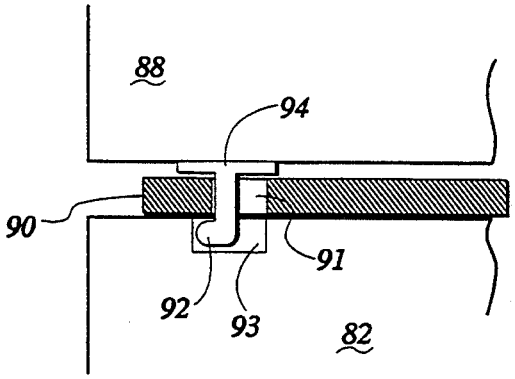
FIG. 14 is an isolated view illustrating the interlocking between the top cover and the tray of the embodiment shown in FIG. 13.

The tray 84 includes a floor with four side walls extending upwardly therefrom. From the upper edge of each of the walls extends a pair of vertically-extending tabs 90 each of which, as also shown in FIG. 14, includes a slot 91. Eight engagement elements 94 are attached to and extend downwardly from the underside of the top cover 88. These elements 94 correspond to the eight tabs 90, with their slots 91 each configured to accept a hooked protrusion 92 extending from an engagement element 94. The hooked protrusions each define a "shelf" or "shoulder" for engagement purposes. The engagement elements 94 may be attached to the underside of the top member 88 by sewing, gluing, or other attachment means known in the art.

It may be understood that, in order to assemble mattress 80, the previously-discussed "sliding" process is not utilized. Instead, the top member 88 is positioned above and preferably in registration with the base 82, with the tray 84 positioned within the cavity of the base 88, and the bladders within the cavity of the tray. The top cover 88 is then brought downwardly such that each of the hooked protrusions 92 of the engagement elements 94 enters into a corresponding slot 91 defined by tabs 90. Cavities 93 in the perimeter of the base (see only FIG. 14) allow for clearance of the hooked protrusions. Some downward pressure may be necessary in order to fully engage the hooked protrusions 92 into place. Thereafter, it is only necessary to disengage a few adjacent hooked protrusions from their position in order to bend the top member 88 out of place to access the bladder or bladders thereunder.

It may be seen that the hooked protrusions 92 each have their "barb" or "hook" extending outwardly relative to the center of the mattress. It may be understood that this is advantageous in that when a load is placed atop the cover 88, the hooked protrusions may tend to be urged outwardly, which encourages, engagement of the hooked protrusions.

Fourth Preferred Embodiment

Figure 15:
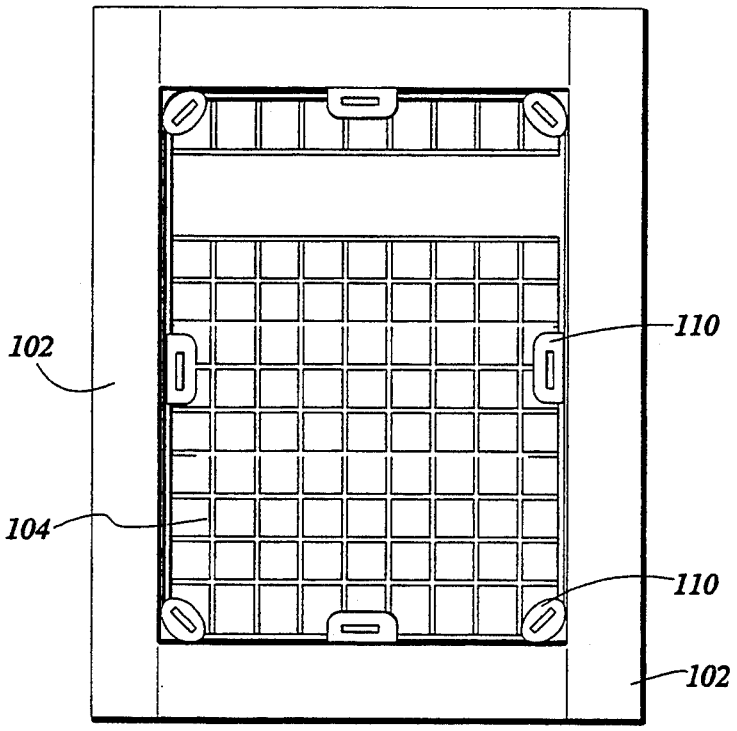
FIG. 15 is a top plan view of the tray and base of a fourth embodiment of the invention, without any water-filled bladders in place within the tray.
Figure 16:
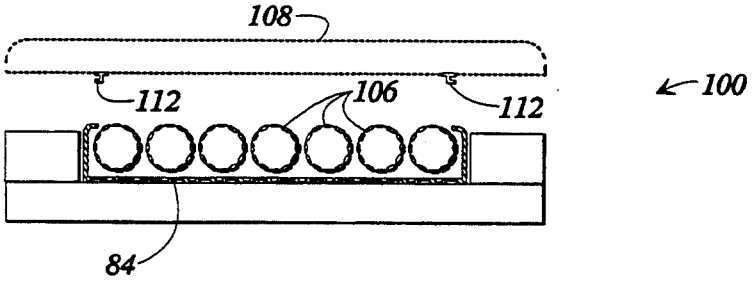
FIG. 16 is a side cross-sectional semi-exploded view of the mattress assembly according to a fourth embodiment of the invention, with the top cover shown in phantom.

Referring now to FIG. 15, another embodiment of the invention is described. A mattress 100 includes a base 102, a tray 104, a plurality of bladders 106 within the tray, and a top cover 108 covering the base, tray, and bladders.

Figure 17:
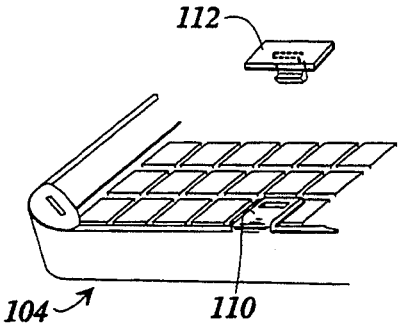
FIG. 17 is a partial view of the tray of the fourth embodiment, illustrating the interaction of an engagement member with one of the tabs extending from the edge of the tray.

The base 102 is similar to some of those described above, in that it includes a flat bottom foam layer, and a perimeter of foam. The tray 104 has a floor, and four vertical walls extending upwardly from the edges of the floor. The tray 104 also includes a plurality of tabs 110, which extend inwardly relative to the upper edges of the tray side walls, shown in detail in FIG. 17. As in the previously-discussed embodiment, a plurality of engagement elements 112 are attached and extend downwardly from the lower surface of the top cover 108. These engagement elements 112 correspond in number to the tabs 110, and engage the tabs in a manner similar to that discussed with respect to the embodiment illustrated in FIGS. 12–14. Once again, the engagement elements included hooked protrusions including "barbs" or "hooks" which extend outwardly relative to the center of the mattress.

Figure 18:
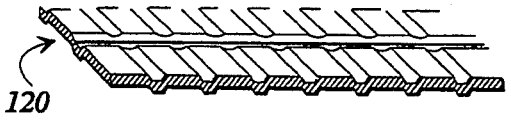
FIG. 18 is a partial view of floor of the tray of the fourth embodiment.

The floor of the tray 104 may include a plurality of ribs or channels to direct leakage as well as to provide structural rigidity, as illustrated at 120 in FIG. 18. A similar configuration may be provided in the other embodiments such as shown at 39 in FIG. 3.

It may be noted that detents or stops could be provided in the sliding engagement elements connecting the cover and base, in order that the installer be aware when the top is in its properly installed location.

It may also be understood that the top cover member may be in engagement (through the sliding or locking features) with the tray or the base members, or both. It is simply preferred that such a top cover member be so engaged with a "lower member", which may be understood as a tray, a base member, or the two combined.

It may also be understood that other materials may be substituted for the above-discussed hook-and-loop material in order to attach the ends of the top cover to the base. For example, a snap connection or zippers may be used.

Leak-proof liners may be interposed intermediate many of the above-discussed elements without departing from the spirit and scope of the present invention. For example, a liner may be interposed intermediate the water bladder(s) and the tray shown in FIG. 1. A liner may also be used underneath the tray.

Fifth Preferred Embodiment

Referring now to FIGS. 19–24, a fifth preferred embodiment of the invention is described. A watermattress assembly 150 includes an upholstered base 151, a tray 154, one or more bladders 156 within the tray, and a foam top cover 158 covering the base, tray, and bladders. It may be understood that the terms "watermattress assembly" and "watermattress configuration" are general terms referring to a watermattress system which includes not only a bladder for containing water, but the entire group of elements which combine to provide a bed for supporting one or more users.

The foam base 151 is similar to some of those previously described, in that it includes a flat bottom foam layer 152 and a perimeter of foam 153, although other configurations are contemplated without departing from the spirit and scope of the present invention. The tray 154 has a floor 159, and four walls (two side walls 160, two end walls 161) which extend upwardly from the four edges of the floor, and each terminates in a flange 166. The floor 159 and walls 161 combine to provide an upwardly-disposed cavity to contain the bladders 156.

Figure 20:
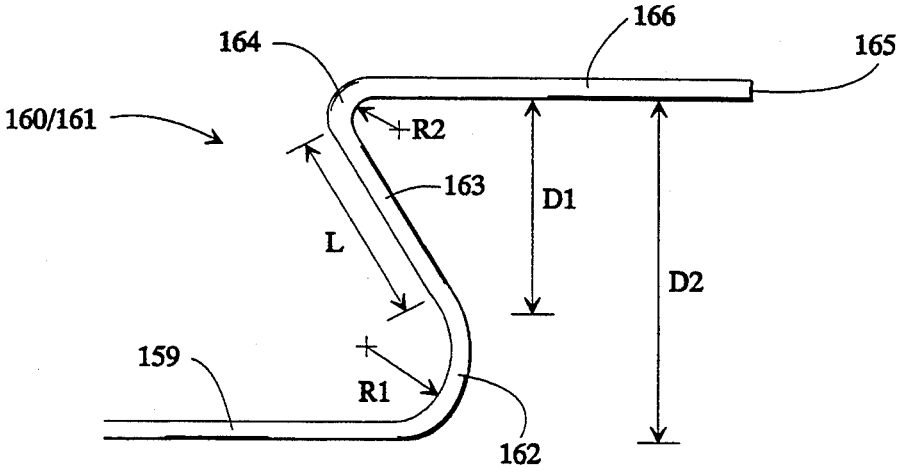
FIG. 20 is a partial cross-sectional view of the side walls of the tray of FIG. 18, at a point not in the comer of the tray. As the cross-section of the side walls is similar to that of the end walls, this figure also is an illustration of the transverse cross-section of the end walls.

The transverse cross sections of the side walls 160 and the end walls 161 are substantially similar, and therefore will be explained in reference to FIG. 20. As may be seen, each wall 160, 161, extends upwardly from the floor 159, and includes a lower curved portion 162, a middle straight portion 163, and an upper curved portion 164. The flange 166 extends outwardly from the curved portion 164 and terminates in an outer peripheral edge 165.

In the preferred embodiment, the radius R1 of the lower curved portion 162 is approximately 1.5 inches. The radius R2 of the upper curved portion 164 is approximately 0.25 inches. The vertical distance D1 from the flange 166 to the intersection of the lower curved portion 162 and straight portion 163 is approximately 3 inches. The vertical distance D2 from the floor 159 to the flange 166, in the preferred embodiment is approximately 4.8 inches, and the wall thickness is approximately 0.125 inches, although other thicknesses such as 0.100 may be used.

The top 158 is attached to the base 151 by means of zipper connection 157, typical in the art.

The S-shaped curved configuration of the side and end walls of the tray configuration are an important part of the present invention. As may be understood, typical trays include straight side and end wall members, which result in undesirable "ridges" felt at the perimeter of the mattress assembly. The provision of the curved walls according to the present invention provides for improved deflectability of the side and end walls. The S-shape, with the lower curve radius being larger than the upper curve radius, allows the bladders or bladder portion adjacent to the walls to "nestle" within the walls, without an undesirable gap being provided between the upper portions of the walls and the bladders, as discussed in further detail later.

Referring back to FIGS. 8 and 9, it may be understood that a variety of other wall configurations having deflectable portions may be provided under the present invention.

Cantilevered corners are another important feature of the present invention. As described, difficulties have arisen in the prior art in unacceptable "ridges" being felt about the perimeter of a waterbed configuration, due to unacceptably rigid side walls. It may be understood that this problem is particularly troublesome at the intersection of the side and end walls, namely at the comers; in practice it has been found that these corners provide four unacceptable "hard spots" in waterbed configurations including trays.

Figure 21:
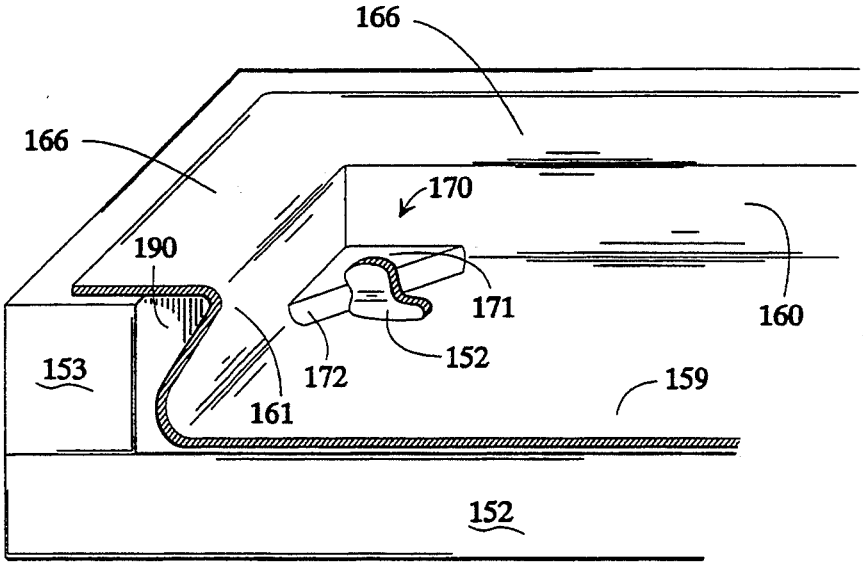
FIG. 21 is a partial view of the tray of the fifth embodiment watermattress configuration, viewing one comer of the tray, which includes a cantilevered comer which has been partially cut away to illustrate the space intermediate the comer and the foam base.
Figure 22:
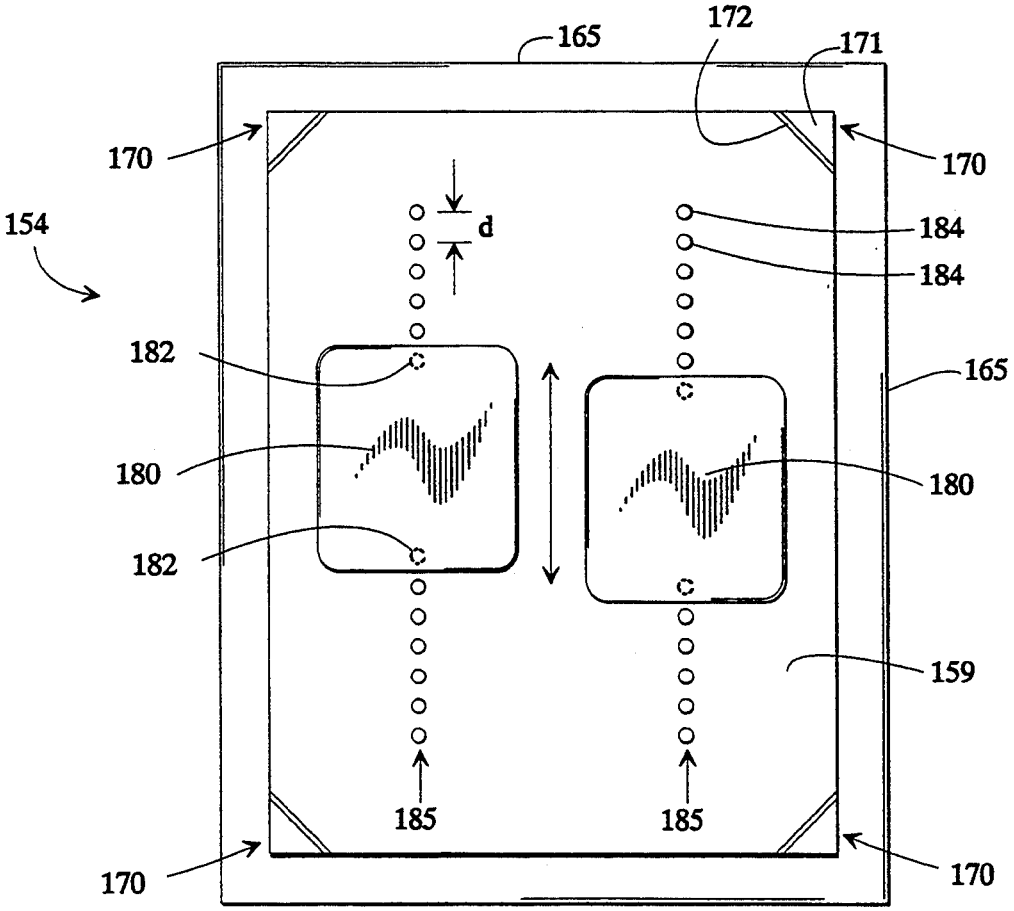
FIG. 22 is a simplified top plan view of the interaction of the lumbar support members and the floor of the tray of FIG. 20.

As may be seen in FIG. 21, a "cantilevered comer" is provided under the present invention. It may be understood that although the side and end walls 160, 161, along with the floor 159 may all be in at least partial contact with foam, the cantilevered corners 170 including a suspended floor 171 portion and a diagonal wall 172, respectively, provide some distance between the suspended floor portion 171 and the foam base 152. Thus, when one sits on one comer of the trays, the cantilevered comer will be able to "deflect" somewhat in comparison to a corner which does not include such cantilevering. This deflection is made possible by an air space provided between the suspended floor portion 171 and the foam base 152, which is approximately the height of the diagonal wall 172.

The diagonal wall 172 in the preferred embodiment is not vertical, but instead sloped somewhat, with the slope approximating the slope of the side and end walls at the portion of their heights. It is believed that some "flexing" along the line of intersection between the suspended floor portion 171 and the diagonal wall 172 occurs, which provides a cantilever spring effect which is desirable.

The suspended floor portion 171 is part of the floor 159, in that it provides support of the water bladder or bladders lying thereon. The floor portion partially defines the outer perimeter of the floor 159, which may be understood to be the peripheral location at which the wall of the tray extend upwardly from the floor.

Preferably, the cantilevered corners are provided at each of the four comers of the tray, although less than such an amount is contemplated under the present invention.

Figure 25:
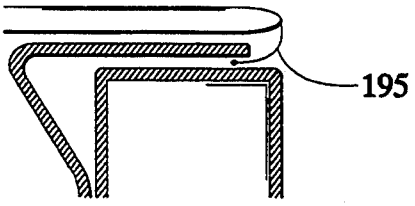
FIG. 25 illustrates a view of a partial transverse cross section of a side wall portion of the watermattress assembly of FIG. 19, illustrating a modification in that a flexible "skirt" is used, which is attached to the bottom of a top of the assembly, and attaches around the flanges of the tray much as would a fitted sheet fit around a mattress.

The flanges 166 of the side and end walls extend outwardly almost to the outer edge of the foam perimeter as shown in FIG. 21. These flanges include several advantages. First of all, the flanges assist in allowing the tray to regain its original shape after a load is placed and removed from the side or end walls. Secondly, when a heater is used, heat is transferred by conduction through the floor of tray, through the walls, and subsequently to the flanges 166. This is advantageous in that improved heat dispersal is provided. Thirdly, the flanges cover a "gap" 190 (See FIGS. 19 and 21) which could otherwise be present between the bladders and the foam perimeter 153. Instead of the gap providing an upwardly-directed opening, such an opening is covered by the flanges 166. Finally, the flange may be used as an attachment means for attaching the top 158, or other desirable members such as a thermal insulation layer, to the tray 154. A flexible, elastic, skirt 195 (See FIG. 25) could be attached to the underside perimeter of the top, which could be stretched around all of the flanges, such that the skirt encircles the outer peripheral edge 165 of the tray and holds the top in place, instead of the use of a zipper connection shown in FIG. 19. Alternately, such a top/tray connection could be made by the use of snap-fit or keyhole/tab interconnections; in a snap-fit connection, a plurality of male snap heads could be affixed to the underside perimeter of the top cover, such that the heads snap-fit into holes defined in the flanges. In a keyhole/tab connection, headed tabs could be so attached to the top, and a plurality of keyholes could be provided in the flanges.

Figure 23:
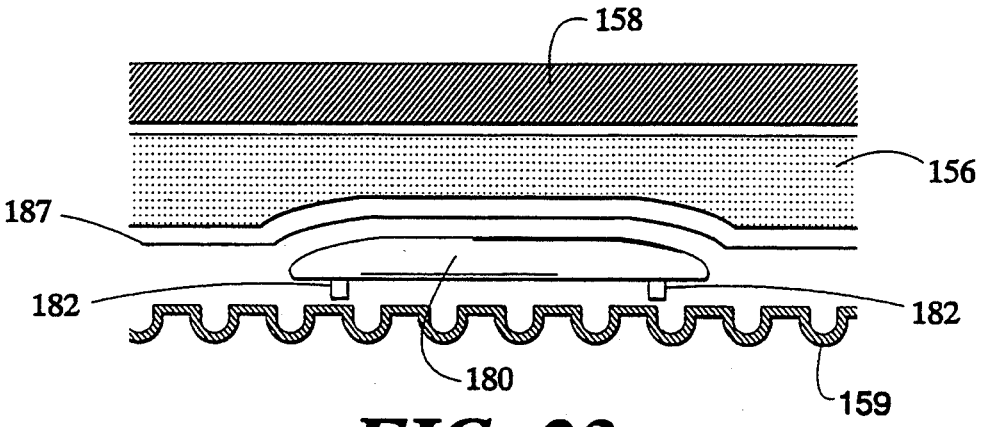
FIG. 23 is a partial longitudinal cross-sectional exploded view of the mattress of FIG. 18, with a section taken of the tray floor, the lumbar support member, the heater, the water bladder, and the top.
Figure 24:
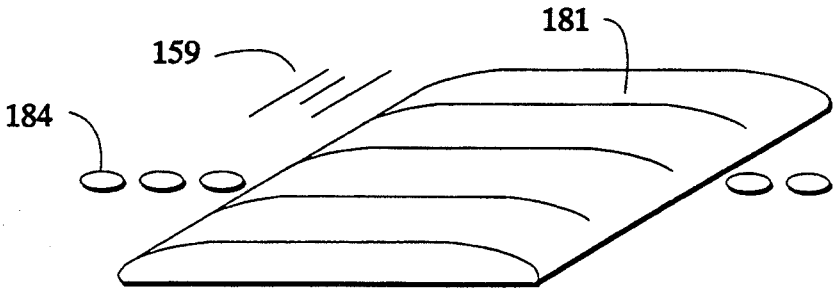
FIG. 24 is an isolated pictorial view of the lumbar support member, illustrating its interaction with a portion of the tray floor. The arrow illustrates the direction along which the support member may be adjusted relative to the tray floor.

Adjustable lumbar supports are another important feature of the present invention. As may seen in FIG. 22, a pair of adjustable lumbar supports 180 may be adjusted along the floor 159 of the tray. Referring also to FIGS. 23 and 24, the adjustable lumbar support is somewhat "hump"-shaped with a curved upper surface 181, and includes a pair of positioning pegs 182. These positioning pegs 182 are configured to fit within holes 184 within two rows 185 of holes provided on each side of the floor of the tray d distances apart.

As may be understood, each lumbar support 180 may be positioned upwardly and downwardly along the rows 185 of holes, depending on the preference of the user. The user may wish to have the hump-shaped lumbar support at or about his or her lumbar region, but as may be understood that this region may vary depending on the size and preferences of the user. As may be seen FIG. 22, the left-side lumbar support is positioned somewhat higher than the right-side lumbar support.

Figure 19:
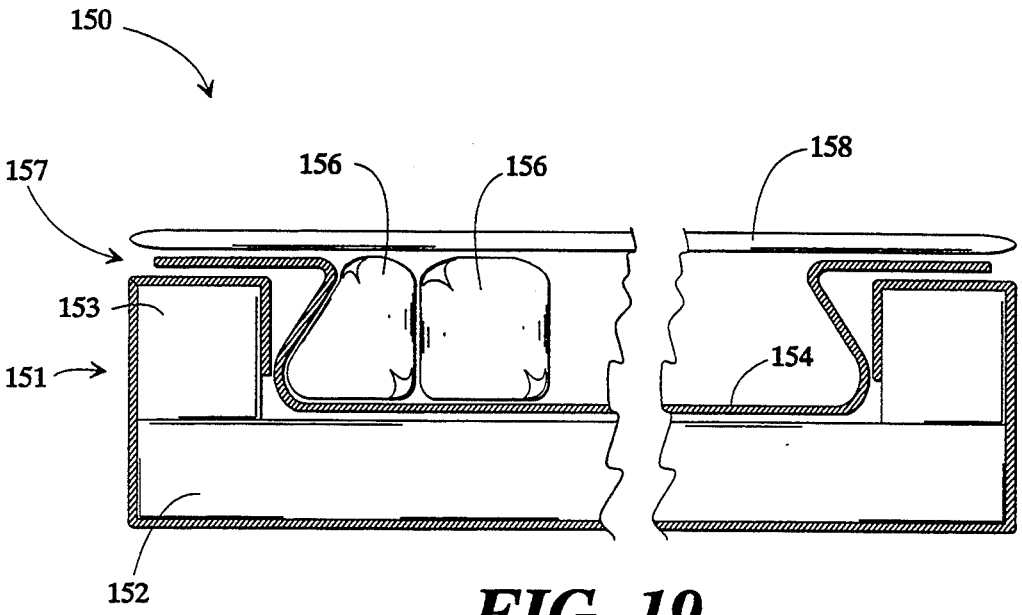
FIG. 19 is a cross-sectional view of a fifth watermattress configuration, with the cut being taken transversely of the mattress, that is, through the side walls. A plurality of water bladders are shown, although only one could be used.

Once the lumbar supports 180 are in place, one or more water bladders 156 are placed on top of the lumbar supports as seen in FIG. 23, and the mattress is assembled as illustrated in FIG. 19. If desired, a planar, flexible, waterbed heater 187 such as known in the art may be positioned intermediate the lumbar support member 180 and the water bladder 156, as well as intermediate the floor portion 159 and the water bladder 156. Should the user ever wish to adjust one of the lumbar supports, the top 158 will be removed, bladders 156 (and a heater if used) on top of the particular lumbar support will be moved, the lumbar support will be adjusted along the length of its row of holes, and the removed materials will then be replaced.

As discussed above, heaters may be positioned in the water mattress configuration. It is preferable to put the heaters atop the lumbar supports. The positioning of the row of holes in the floor as shown in FIG. 23 discourages positioning of heaters underneath the lumbar supports.

It may be understood that the tray 154 according to this invention is, in its preferred embodiment, formed by a process known as "vacuum forming" in which a sheet of plastic material is rendered temporarily pliable (typically by heating) and then is placed upon a mold having vacuum parts causing the plastic material to be drawn toward the mold by air pressure. To form the preferred embodiment, a sheet of low density polyethylene (LDPE) may be used for the tray, although any polymeric material may be used without departing from the spirit and scope of the present invention. Of course, other materials may be used without departing from the spirit and scope of the present invention, such as PVC or ABS. The lumber supports are made of vacuum-formed ABS, although PVC or LPDE could be used.

Coil springs, including pocketed coil springs may also be used in the perimeter without departing from the spirit and scope of the present invention.

As discussed above, more than one bladder may be used within the above-discussed trays. Furthermore, fabric or other material known in the art may be used inside the bladders in order to reduce wave effects therefrom.

The bladders or "water bags" are configured to hold water or other fluids therein. The bladder may be composed or 20 mil vinyl or other acceptable bladder material known in the art.

With respect to configuration of FIG. 4, it may also be understood that the positioning of the hook-and loop fastening strips may be exchanged for the positioning of the channel assemblies and their respective flanges. In such a configuration, the top cover would be "slid" in from one side of the base.

While this invention has been described in specific detail with particular reference to the disclosed embodiments, it will be understood that many variations and modifications may be effected within the spirit and scope of the invention as described in the appended claims.

What is claimed is:

1. A water mattress construction, comprising:

an elongate base having a longitudinal axis;

a tray having a longitudinal axis and disposed atop said base such that the longitudinal axis of said tray is substantially parallel to said longitudinal axis of said base;

a top portion disposed atop said tray portion, said top portion combining with said tray and base portion to define an inner cavity;

a liquid-filled bladder; and at least one lumbar support member positioned intermediate said bladder and said tray said lumbar support being slidably adjustable along the longitudinal axis of said tray.

2. The water mattress construction as claimed in claim 1, wherein said lumbar support member is finitely adjustable along said axis.

3. The water mattress construction as claimed in claim 2, wherein said lumbar support member is finitely adjustable along said axis by means of at least one pin extending downward from aid support member, which is accepted by at least one hole in a row of holes defined by said tray.

* * * * *